US007021967B2

(12) United States Patent
Mullin

(10) Patent No.: US 7,021,967 B2
(45) Date of Patent: Apr. 4, 2006

(54) CABLE SHIELD CONTACT

(75) Inventor: Daniel J. Mullin, Plantsville, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 10/991,841

(22) Filed: Nov. 18, 2004

(65) Prior Publication Data

US 2005/0124215 A1 Jun. 9, 2005

Related U.S. Application Data

(60) Provisional application No. 60/523,440, filed on Nov. 19, 2003.

(51) Int. Cl.
*H01R 9/03* (2006.01)

(52) U.S. Cl. ..... 439/610; 439/583

(58) Field of Classification Search ..... 439/610, 439/583, 98–99, 274, 578
See application file for complete search history.

(56) References Cited

U.S. PATENT DOCUMENTS 4,493,525 A * 1/1985 Hall et al. ..... 439/610
5,145,409 A * 9/1992 Sato et al. ..... 439/585
5,372,513 A 12/1994 Rodrigues et al. ..... 439/98
5,409,400 A * 4/1995 Davis ..... 439/610
5,667,407 A * 9/1997 Frommer et al. ..... 439/610
6,059,607 A * 5/2000 Wilson ..... 439/610
6,328,601 B1 * 12/2001 Yip et al. ..... 439/608
6,358,091 B1 3/2002 Lo et al. ..... 439/608
6,609,934 B1 * 8/2003 Chen et al. ..... 439/610
2004/0266230 A1 * 12/2004 Chiran et al. ..... 439/92

OTHER PUBLICATIONS

International Search Report, PCT/US04/38711, Jul. 29, 2005.

* cited by examiner

*Primary Examiner*—Michael C. Zarroli
(74) *Attorney, Agent, or Firm*—Cantor Colburn LLP

(57) ABSTRACT

A conductive shield contact including a plurality of fingers formed in a partial circle for contacting a cable shield, the fingers being separate elements, each finger having a first end and a second end. A partial circular member is positioned at a second end of the fingers and is connected to the fingers. A tab is formed for contacting a conductive portion of a connector to establish an electrical path between the cable shield and the conductive portion of the connector.

13 Claims, 6 Drawing Sheets

CABLE SHIELD CONTACT

CROSS REFERENCE TO RELATED APPLICATIONS

This application claims the benefit of U.S. provisional patent application, Ser. No. 60/523,440 filed Nov. 19, 2003, the entire contents of which are incorporated herein by reference.

BACKGROUND OF THE INVENTION

Existing cable shield contacts are known. FIG. 1 illustrates a perspective view of an existing assembled plug, shown generally as 100. The plug 100 is similar to plugs in U.S. Pat. No. 6,358,091, the entire contents of which are incorporated herein by reference. The plug 100 includes a top cover 102, a bottom cover 104 and a core 106. The top cover 102, bottom cover 104 and core 106 are all conductive to provide shielding as described herein. These conductive components may be made from metal, metallized plastic or any other known conductive material. Core 106 supports insulative (e.g. plastic) contact carriers 108. Each contact carrier 108 includes two contacts 160 defining a pair. A boot 112 provides strain relief and is made from a pliable plastic or rubber. Also shown in FIG. 1 is cable 10 entering boot 112. A latch 114 is provided on the top cover 102 for coupling the plug 100 to outlet (not shown).

FIG. 2 is an exploded, perspective view of the top cover 102. The top cover includes a shield contact 164 that electrically connects the ground layer of cable 10 to the plug core 106. Shield contact 164 is conductive and is preferably made from metal. Shield contact 164 has an arcuate portion 166 formed to generally follow the shape of cable 10. Arcuate portion 166 includes barbs 168 that pierce the ground layer of cable 10 and the cable jacket. This electrically and mechanically connects the shield contact 164 to cable 10. Shield contact 164 includes a pad 170 having two openings 172 formed therein for receiving two posts 176 formed in top cover 102. The friction fit between posts 176 and openings 172 secures the shield contact 164 to top cover 102. A tab 174 extends away from pad 170 and contacts the plug core 106. A channel 178 is formed in the top cover 102 for receiving central ridge 144 on plug core 106.

FIG. 3 is an exploded, perspective view of the bottom cover 104. Bottom cover 104 is similar to top cover 102 in that both use shield contact 164 in the same manner.

In addition, FIG. 4 illustrates a graph of the calculated transfer impedance of the shield contact 164. The dashed line illustrates the limit of the transfer impedance.

Other existing shield connection consist of single or double bar type contacts that contacted a minimal amount of cable shield area due to the non-uniform geometry of the cable and shield in the terminated state. Other solutions include U.S. Pat. No. 5,372,513 that includes an arcuate cable engagement section 122. The same manufacturer has produced a cable engagement ground clip having a planar tab, divided into separate, planar fingers. Specifications are demanding better transfer impedance and coupling attenuation performance than existing designs provide.

SUMMARY OF THE INVENTION

The above-discussed and other drawbacks and deficiencies of the prior art are overcome or alleviated by a cable shield contact. A conductive shield contact including a plurality of fingers formed in a partial circle for contacting a cable shield, the fingers being separate elements, each finger having a first end and a second end. A partial circular member is positioned at a second end of the fingers and is connected to the fingers. A tab is formed for contacting a conductive portion of a connector to establish an electrical path between the cable shield and the conductive portion of the connector.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION

Figure 1:
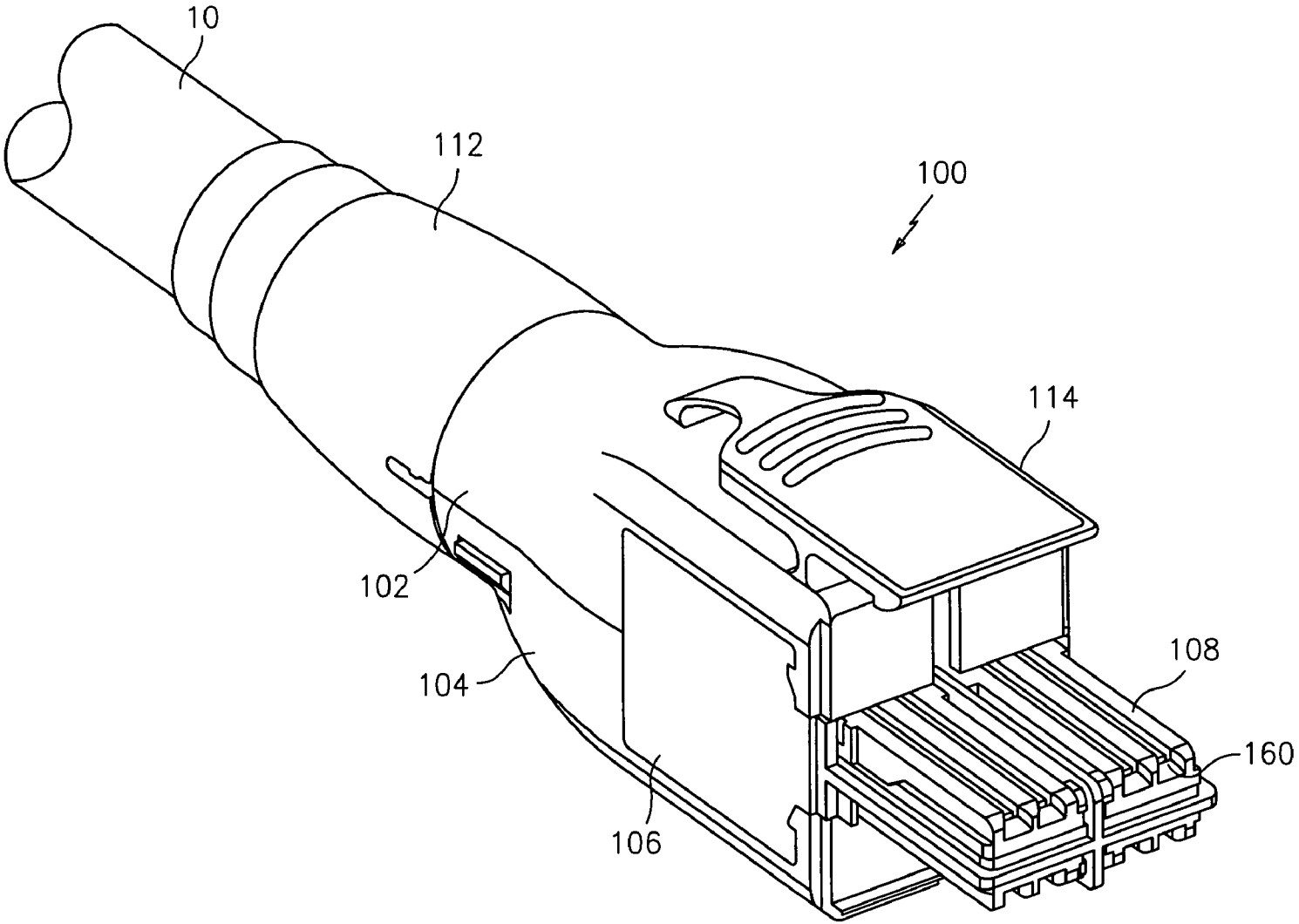
FIG. 1 (PRIOR ART)
FIG. 1 is a perspective view of an existing assembled plug.
Figure 2:
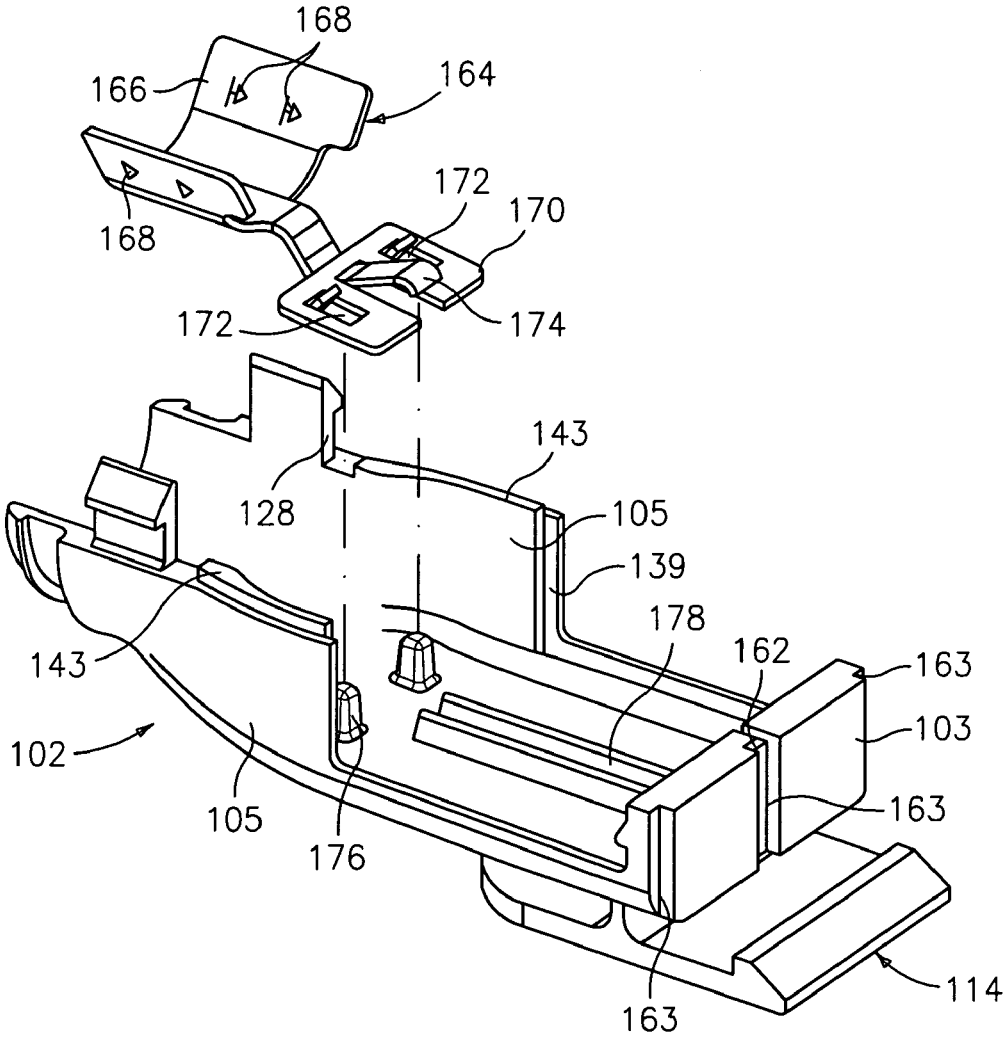
FIG. 2 (PRIOR ART)
FIG. 2 is an exploded, perspective view of the plug top cover of FIG. 1.
Figure 3:
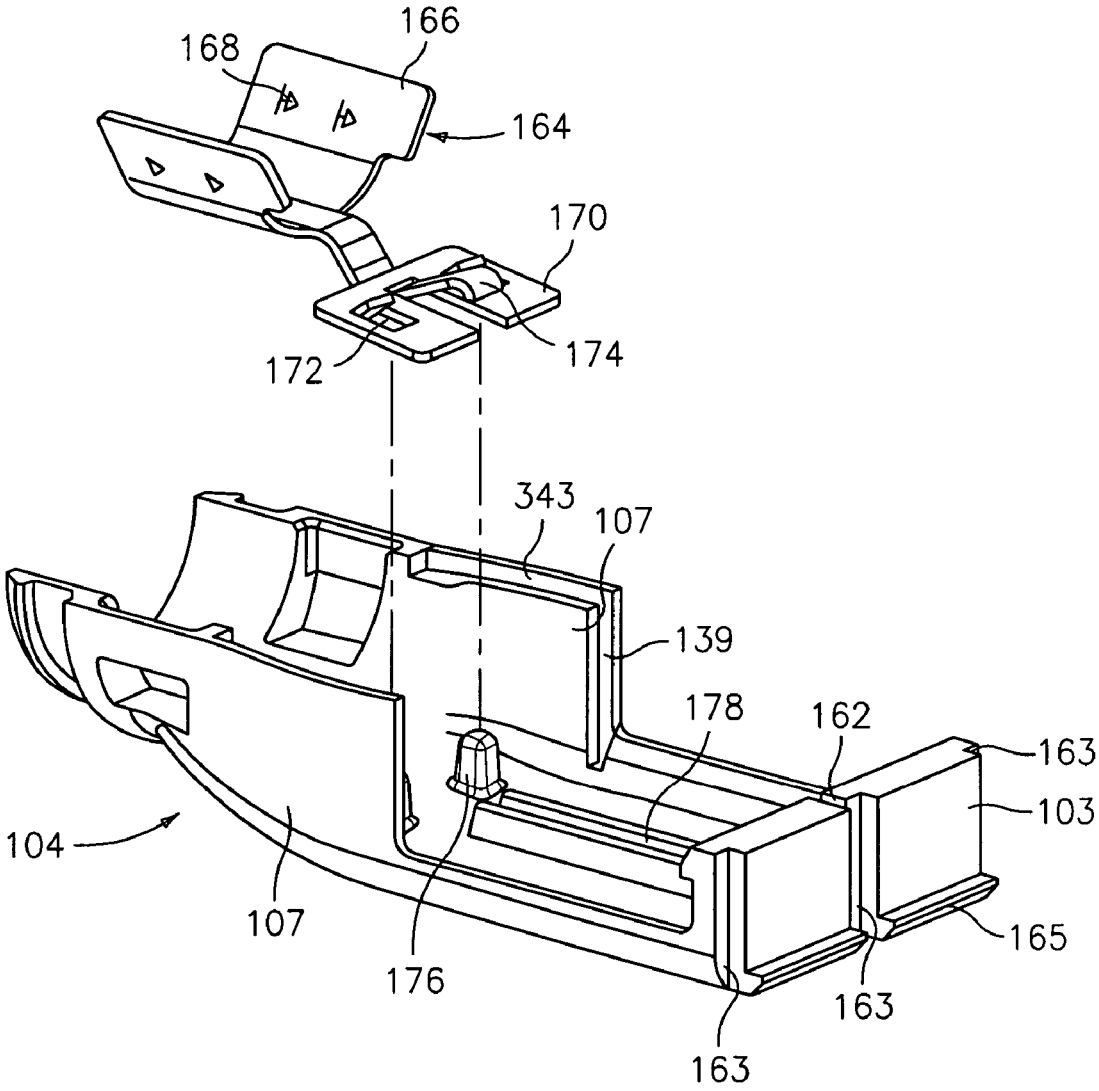
FIG. 3 (PRIOR ART)
FIG. 3 is an exploded, perspective view of the plug bottom cover of FIG. 1.
Figure 4:
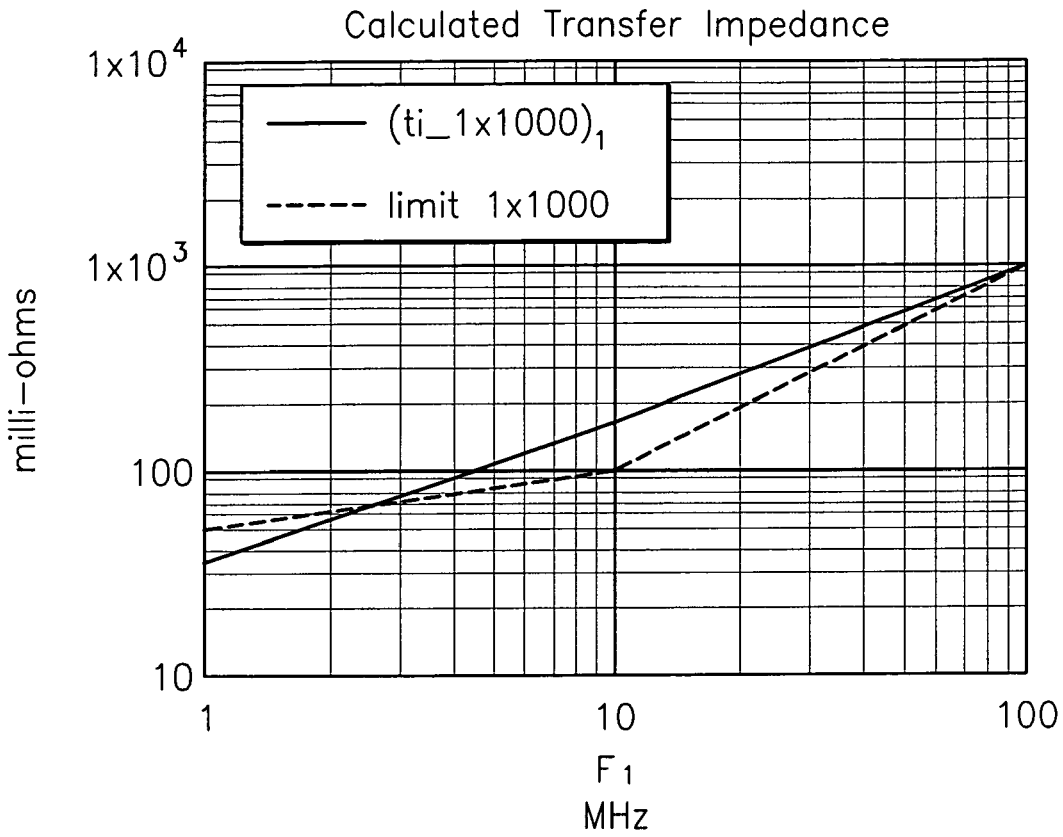
FIG. 4 (PRIOR ART)
FIG. 4 is a graph of the calculated transfer impedance of the shield contact of FIG. 1.
Figure 5:
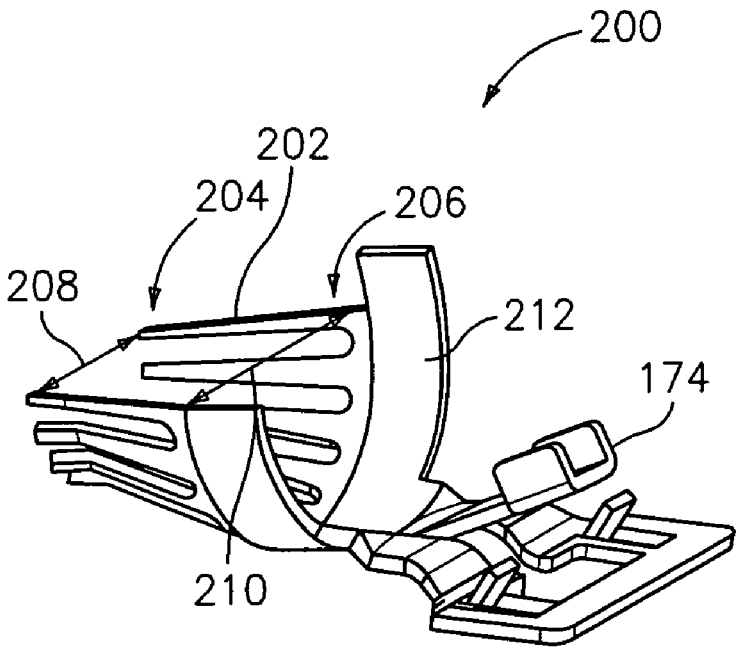
FIG. 5 is a front perspective view of a cable shield contact for a connector.
Figure 6:
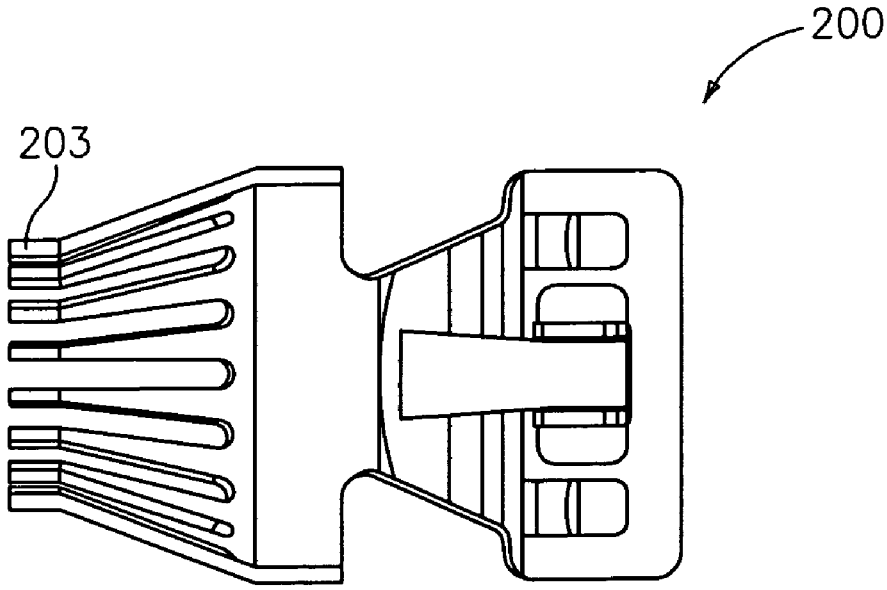
FIG. 6 is a bottom view of the shield contact of FIG. 5.

FIG. 5 illustrates a cable shield contact 200 that can be incorporated into any existing connector (e.g., plug, outlet, etc.) and in particular into a top cover and a bottom cover of the plug, such as shown in the existing plug 100 (see FIGS. 1–3). Shield contact 200 is conductive and is preferably made from metal. Shield contact 200 has a plurality of fingers 202 that are formed around a diameter of a cable (not shown). FIG. 5 illustrates an exemplary embodiment of the fingers arranged in a semi-circle contacting about 180 degrees of the cable shield. The fingers 202 generally follow the shape of the cable. The fingers can also be arranged so as to cover a quarter of a diameter of the cable or about 90 degrees of the cable shield. Embodiments of the invention are not limited to specific radial coverage of the fingers and exemplary embodiments may have fingers arranged radially from about 90 degrees to about 180 degrees. The cable shield contact 200 improves as the fingers 202 cover more of the cable shield.

The plurality of fingers 202 have a first end 204 and a second end 206. A cross-section 208 of the plurality of fingers at the first end 204 is smaller than a cross-section 210 of the plurality of fingers at the second end 206 and at member 212. The smaller cross-section 208 provides a gripping action to the cable shield 254 (FIG. 8) and may be smaller that the cross-section of the cable shield. This smaller cross-section at the first end of the fingers 202 results in a spring pressure being applied by the fingers to the cable shield. The first end 204 of the plurality of fingers 202 may be lanced to provide improved gripping action. In other words, the first end of the fingers are bent outward away from the centerline to form finger tips 203 that will be tangential to the outside surface of the cable shield when the cable is positioned between fingers 202.

The plurality of fingers 202 are held together at the second end 206 by a member 212. In an exemplary embodiment, member 212 is a semi-circle member that also surrounds the cable. However, member 212 can be any type of member 212 that can hold the plurality of fingers together at the second end.

In addition, the plurality of fingers 202 can move individually, which allows for individual contacts to form around the cable shield and also allows for varying surface height and contact areas. Each finger 202 is free to move up or down to contact the cable shield providing a more reliable and less resistive connection.

The fingers 202 may be inserted under the insulative, outer jacket of the cable to make electrical and physical contact with the cable shield. Alternatively, the outer jacket of the cable may be removed exposing the cable shield. The cable shield may then be peeled back over the cable jacket. The fingers 202 are then placed in physical and electrical contact with the cable shield. Tab 174 contacts connector core 106 in a similar manner as described in U.S. Pat. No. 6,358,091.

Figure 8:
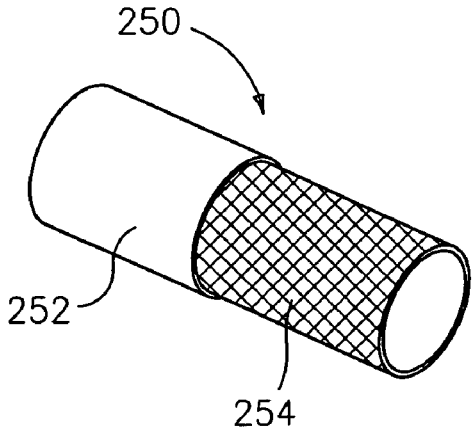
FIG. 8 depicts an exemplary cable for use with the shield contact of FIG. 5.

FIG. 8 depicts an exemplary cable 250 for use with shield contact 200. The cable 250 includes an insulative jacket and a conductive shield 254 positioned beneath the insulative jacket 252. The conductive shield 254 may be a braid, a foil, or another conductive material. As described above, apportion of the jacket 252 may be removed, as shown in FIG. 8, and the finger tips 203 contact the conductive shield 254. Alternatively, the jacket 252 may extend to the end of conduct shield 254. In this embodiment, the fingers 202 are positioned beneath the jacket 252 and in contact with the conductive shield 254.

The advantage of the shield contact 200 is that it provides a low resistance path from the cable shield (not shown) to the next physical ground path on a connector. This could be a connector shield, connecting block shield, patch panel, cable outlet box ground tab or coupler, etc. The term connector is used in a generic fashion to encompass a variety of components. In addition, the shield contact requires no additional tools and allows for different diameter cables and shield materials (foil vs. braid). Maintaining proper ground requires maintaining a low resistance connection from one point of the ground circuit to the next. If the ground path is a cable shield, when that cable is cut into to terminate to a connector, the connection of the shield to this next physical path must be low in resistance. The shield in the cable and other devices is required to maintain safe passage for high current faults as well as to provide electric immunity and electro magnetic compatibility. In other words the shield protects the internal items of the cable (electrical transmission wires) from outside electrical interference and it protects anything near the cable from electromagnetic energy emitted by the internal transmission wires. A breakdown of the path can result in excessive electrical noise being radiated outward, therefore affecting nearby electronics or it could allow outside electrical interference to penetrate into the cable and corrupt the signal on the internal transmission wires. The shield contact 200 provides a repeatable and user-friendly field termination method for cables that result in a low resistance connection to the cable shield.

Figure 7:
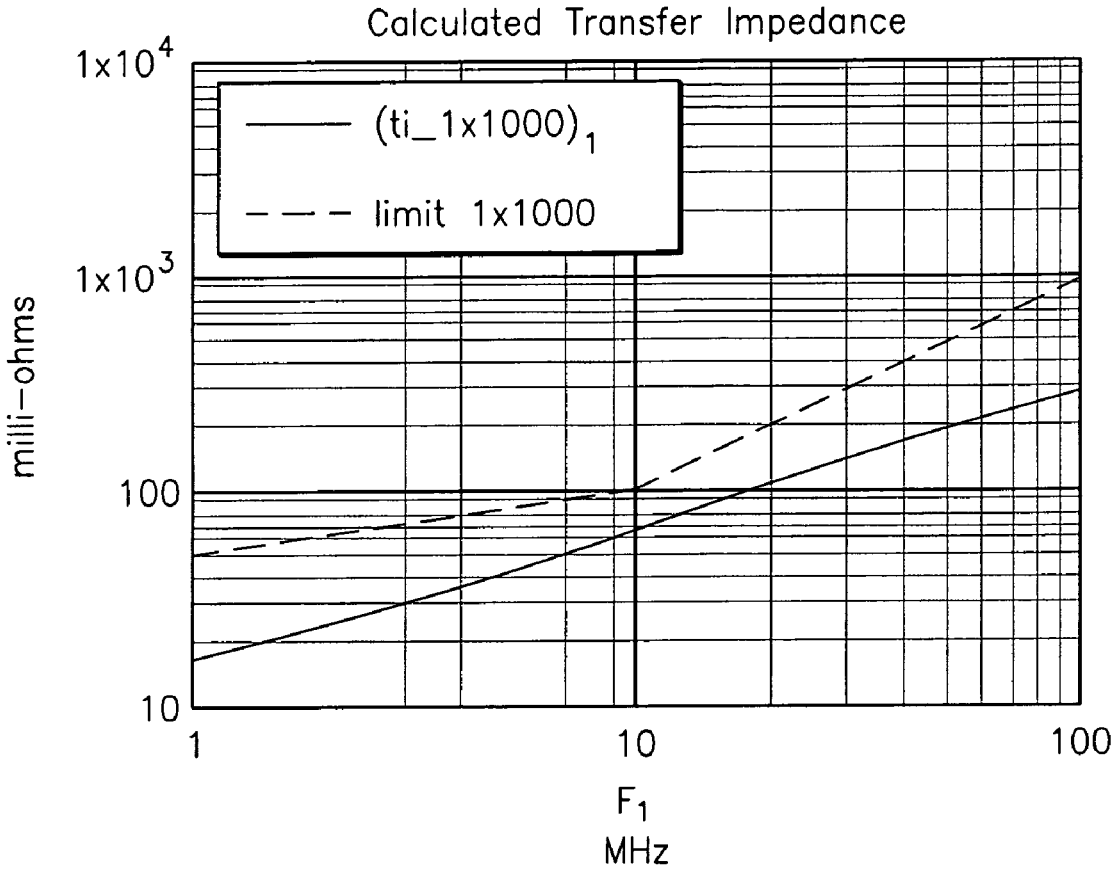
FIG. 7 is a graph of the calculated transfer impedance of the shield contact of FIG. 5.

The improved transfer impedance of the shield contact 200 is illustrated in FIG. 7. There is improved electrical immunity as shown by the transfer impedance testing, which measures how well the shield terminations perform in a cable and connector. The ability to contact more of the cable shield area results in a lower contact resistance and lower conducting path for currents. Present designs for field terminable products cannot conform to the uneven surface areas involved. The fingers 202 contact the cable shield 254 and float independently from each other, which allows the shield contact 200 to conform more easily to the different surface characteristics of the cable shield. This allows more areas of contact and hence lower resistance. This design can also work for a range of cable sizes and can be incorporated in to a housing design to eliminate parts. Moreover, the shield contact 200 requires no special tool when inserting the cable to the plug.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A conductive shield contact comprising:

a plurality of fingers formed in a partial circle for contacting a cable shield, the fingers being separate elements, each finger having a first end and a second end;

a partial circular member positioned at the second end of the fingers and connected to the fingers;

a tab for contacting a conductive portion of a connector to establish an electrical path;

wherein a cross-sectional distance at the first end of the fingers is smaller than a cross-sectional distance at the second end.

2. The conductive shield contact of claim 1 wherein:

the fingers are arranged in a partial circle of about 180 degrees.

3. The conductive shield contact of claim 1 wherein:

the fingers are arranged in a partial circle of about 90 degrees.

4. The conductive shield contact of claim 1 wherein:

the fingers are arranged in a partial circle of about 90 degrees to 180 degrees.

5. The conductive shield contact of claim 1 wherein:

the cross-section distance at the first end is smaller than a cable shield diameter.

6. The conductive shield contact of claim 1 further comprising:

a cable having an insulative jacket and the conductive shield, a portion of the insulative jacket being removed exposing the conductive shield, the fingers contacting the conductive shield.

7. The conductive shield contact of claim 1 further comprising:

a cable having a insulative jacket and a conductive shield, a portion of the insulative jacket being removed exposing the conductive shield, the fingers contacting the conductive shield.

8. A conductive shield contact comprising:

a plurality of fingers formed in a partial circle for contacting a cable shield, the fingers being separate elements, each finger having a first end and a second end;

a partial circular member positioned at the second end of the fingers and connected to the fingers;

a tab for contacting a conductive portion of a connector to establish an electrical path;

wherein the first ends of the fingers are bent outward away from a centerline of the partial circle to form a finger tip for tangentially contacting the cable conductive shield.

9. The conductive shield contact of claim 8 wherein:

the fingers are arranged in a partial circle of about 180 degrees.

10. The conductive shield contact of claim 8 wherein:

the fingers are arranged in a partial circle of about 90 degrees.

11. The conductive shield contact of claim 8 wherein:

the fingers are arranged in a partial circle of about 90 degrees to 180 degrees.

12. The conductive shield contact of claim 8 further comprising:

a cable having an insulative jacket and the conductive shield, a portion of the insulative jacket being removed exposing the conductive shield, the fingers contacting the conductive shield.

13. The conductive shield contact of claim 8 further comprising:

a cable having a insulative jacket and a conductive shield, a portion of the insulative jacket being removed exposing the conductive shield, the fingers contacting the conductive shield.

* * * * *